US010978241B2

(12) United States Patent
Whittle et al.

(10) Patent No.: US 10,978,241 B2
(45) Date of Patent: Apr. 13, 2021

(54) TRANSFORMERS HAVING SCREEN LAYERS TO REDUCE COMMON MODE NOISE

(71) Applicant: Astec International Limited, Kowloon (HK)

(72) Inventors: Rex William James Whittle, Sai Kung (HK); Chi Wai Kevin Wong, Ma On Shan (HK)

(73) Assignee: Astec International Limited, Kowloon (HK)

( * ) Notice: Subject to any disclaimer, the term of this patent is extended or adjusted under 35 U.S.C. 154(b) by 549 days.

(21) Appl. No.: 15/832,428

(22) Filed: Dec. 5, 2017

(65) Prior Publication Data

US 2018/0166205 A1 Jun. 14, 2018

Related U.S. Application Data

(60) Provisional application No. 62/432,164, filed on Dec. 9, 2016.

(51) Int. Cl.

| | |
|---|---|
| ***H01F 27/32*** | (2006.01) |
| ***H01F 27/28*** | (2006.01) |
| ***H01F 41/06*** | (2016.01) |
| ***H01F 27/24*** | (2006.01) |
| ***H01F 27/36*** | (2006.01) |

(52) U.S. Cl.

CPC ..... *H01F 27/2885* (2013.01); *H01F 27/24* (2013.01); *H01F 27/2823* (2013.01); *H01F 27/36* (2013.01); *H01F 41/06* (2013.01)

(58) Field of Classification Search

CPC ..... H01F 27/288; H01F 27/289; H01F 27/36; H01F 27/385; H01F 27/2885

USPC ..... 336/84 C

See application file for complete search history.

(56) References Cited

U.S. PATENT DOCUMENTS

| | | | | |
|---|---|---|---|---|
| 3,717,808 A | | 2/1973 | Horna | |
| 4,239,077 A | * | 12/1980 | Dixon | B05D 5/10 156/273.5 |
| 5,724,236 A | * | 3/1998 | Oglesbee | H02M 1/12 363/131 |
| 6,704,211 B1 | * | 3/2004 | Vogman | H02M 3/156 363/20 |
| 6,888,436 B1 | * | 5/2005 | Yagasaki | H01F 27/2885 336/69 |

(Continued)

*Primary Examiner* — Alexander Talpalatski
*Assistant Examiner* — Joselito S. Baisa

(57) ABSTRACT

According to some aspects of the present disclosure, transformers having a screen layer and corresponding methods of winding transformers and are disclosed. Example transformers include at least one transformer core, at least one primary winding layer wound about the transformer core, and at least one secondary winding layer wound about the transformer core. The secondary winding layer includes a secondary winding wire having a width and a number of turns per layer. The transformer also includes at least one screen layer wound about the transformer core and disposed between the primary winding layer and the secondary winding layer. The screen layer includes a screen wire having substantially the same width as the secondary winding wire and substantially the same number of turns per layer as the secondary winding wire, to reduce common mode noise in the secondary winding layer.

15 Claims, 6 Drawing Sheets

(56) References Cited

U.S. PATENT DOCUMENTS

| | | | | |
|---|---|---|---|---|
| 7,346,979 | B2 * | 3/2008 | Park | H01F 27/289 29/602.1 |
| 7,737,814 | B1 * | 6/2010 | Damnjanovic | H01F 27/289 336/84 R |
| 7,768,369 | B2 * | 8/2010 | Park | H01F 27/345 336/84 C |
| 8,023,294 | B2 * | 9/2011 | Ryan | H02M 1/14 363/40 |
| 8,228,152 | B2 * | 7/2012 | Lu | H01F 27/36 336/84 R |
| 9,129,736 | B2 * | 9/2015 | Zhou | H01F 27/36 |
| 9,177,714 | B2 * | 11/2015 | Espino | H01F 27/325 |
| 9,666,354 | B2 * | 5/2017 | Zuo | H01F 27/289 |
| 9,722,499 | B2 * | 8/2017 | Martin | H02M 1/44 |
| 10,141,100 | B2 * | 11/2018 | Sheng | H02M 1/12 |
| 2003/0102948 | A1 * | 6/2003 | Wolfgram | H01F 27/245 336/182 |
| 2008/0007375 | A1 * | 1/2008 | Frantz | G01R 33/3815 335/216 |
| 2012/0319688 | A1 * | 12/2012 | Stormont | G01R 33/44 324/322 |
| 2014/0185337 | A1 * | 7/2014 | Espino | H01F 27/325 363/21.17 |
| 2014/0334198 | A1 | 11/2014 | Yang et al. | |
| 2016/0016477 | A1 * | 1/2016 | Sadakata | H01F 38/14 320/108 |
| 2016/0181008 | A1 * | 6/2016 | de Groot | H01F 27/385 363/127 |
| 2017/0163145 | A1 * | 6/2017 | Cheng | H02M 1/12 |

* cited by examiner

TRANSFORMERS HAVING SCREEN LAYERS TO REDUCE COMMON MODE NOISE

CROSS-REFERENCE TO RELATED APPLICATIONS

This application claims the benefit and priority of U.S. Provisional Application No. 62/432,164, filed on Dec. 9, 2016. The entire disclosure of the above application is incorporated herein by reference.

FIELD

The present disclosure relates to transformers having screen layers to reduce common mode noise.

BACKGROUND

This section provides background information related to the present disclosure which is not necessarily prior art.

Common mode noise in switching power converters may include a high frequency current between primary and secondary circuits caused by capacitive coupling between transformer windings, and a voltage across that capacitance. Screens can be used to reduce common mode noise between primary and secondary windings of transformers. The screens typically include a single turn of copper, brass, aluminum, etc., that is grounded on a noise generating side of the transformer. Some transformers include two screens, with one screen adjacent a primary winding of the transformer and the other screen adjacent a secondary winding of the transformer.

Some approaches compensate for a common mode noise voltage in the transformer by connecting a winding of the transformer in an arrangement that causes the winding to produce a voltage opposite in phase to the common mode noise voltage generated in the transformer.

Another approach to reduce common mode noise includes winding a coaxial screen about a secondary winding. Alternatively, a screen can be split into two according to a ratio of primary winding and secondary winding voltages to cancel voltages between the primary winding and the screen, and between the secondary winding and the screen.

SUMMARY

This section provides a general summary of the disclosure, and is not a comprehensive disclosure of its full scope or all of its features.

According to one aspect of the present disclosure, a transformer includes at least one transformer core, at least one primary winding layer wound about the transformer core, and at least one secondary winding layer wound about the transformer core. The at least one secondary winding layer includes a secondary winding wire having a width and a number of turns per layer. The transformer further includes at least one screen layer wound about the transformer core and disposed between the at least one primary winding layer and the at least one secondary winding layer. The at least one screen layer includes a screen wire having substantially the same width as the secondary winding wire and substantially the same number of turns per layer as the secondary winding wire to reduce common mode noise in the at least one secondary winding layer.

According to another aspect of the present disclosure, a method of winding a transformer is disclosed. The transformer includes a core, at least one primary winding layer, at least one secondary winding layer, and at least one screen layer. The method includes winding the at least one primary winding layer about the core of the transformer, and winding the at least one secondary winding layer about the core of the transformer. The at least one secondary winding layer includes a secondary winding wire having a width. The method also includes winding the at least one screen layer about the core of the transformer so the at least one screen layer is disposed between the at least one primary winding layer and the at least one secondary winding layer. The at least one screen layer includes a screen wire having a substantially same width as the width of the secondary winding wire and substantially the same turns per layer as the secondary winding wire to reduce common mode noise in the at least one secondary winding layer.

Further aspects and areas of applicability will become apparent from the description provided herein. It should be understood that various aspects and features of this disclosure may be implemented individually or in combination with one or more other aspects or features. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding features throughout the several views of the drawings.

DETAILED DESCRIPTION

Figure 1:
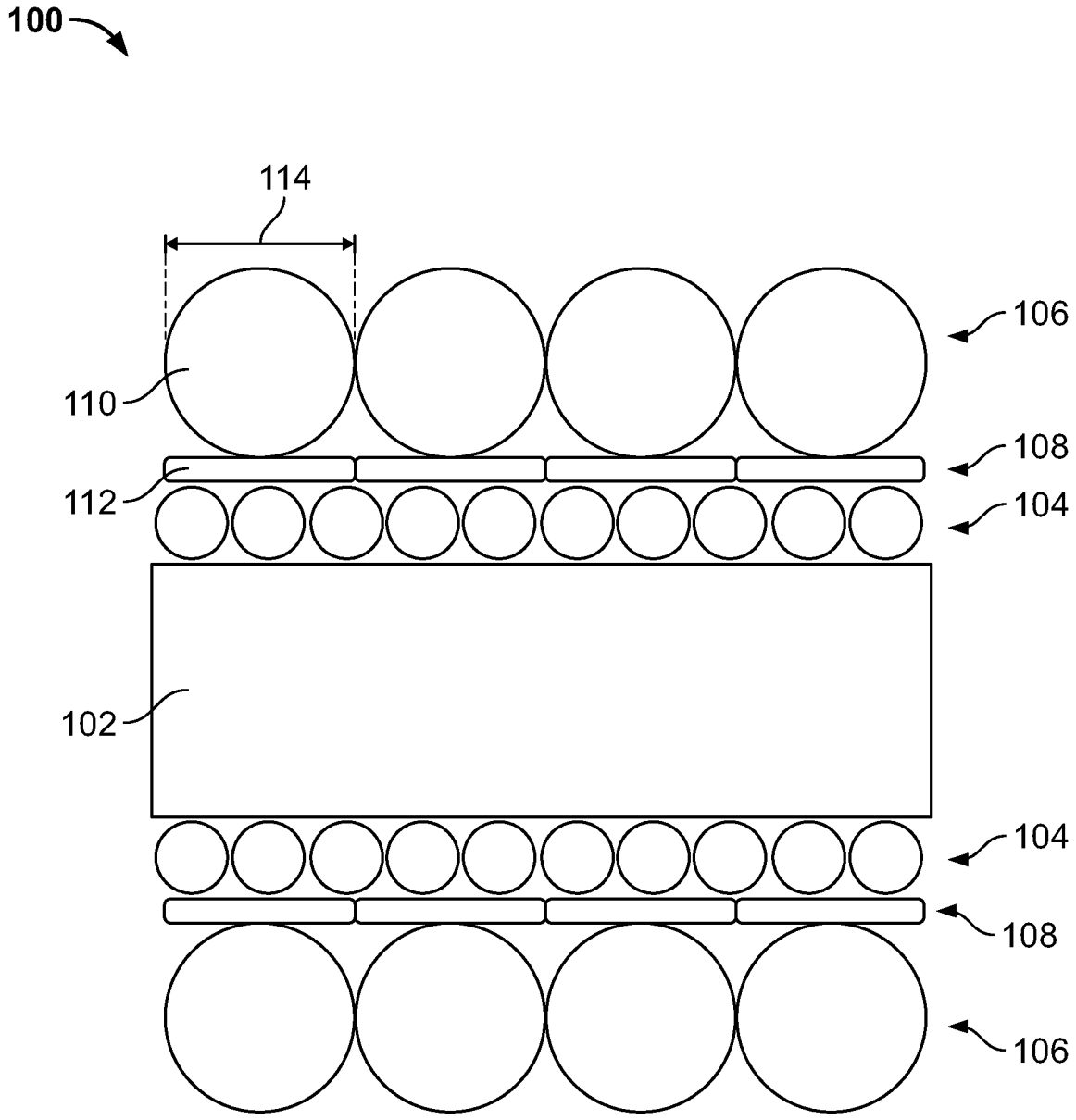
FIG. 1 is a sectional view of a transformer according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A transformer according to one example embodiment of the present disclosure is illustrated in FIG. 1 and indicated generally by reference number 100. As shown in FIG. 1, the transformer 100 includes a transformer core 102, and a primary winding layer 104 wound about the transformer core 102.

The transformer 100 also includes a secondary winding layer 106 wound about the transformer core 102. The secondary winding layer 106 includes a secondary winding wire 110 having a width 114.

A screen layer 108 is wound about the transformer core 102. The screen layer 108 includes a screen wire 112. The screen wire 112 has substantially the same width as the secondary winding wire 110. The screen layer 108 also has substantially the same number of turns as the secondary winding layer 106.

As shown in FIG. 1, the secondary winding layer 106 is wound about the primary winding layer 104. The screen layer 108 is disposed between the primary winding layer 104 and the secondary winding layer 106. In other embodiments (and as further described below), the winding order of the primary winding layer 104, the secondary winding layer 106, and the screen layer 108 may be arranged differently. The windings may be close wound in order to reduce spacing between wire turns and reduce noise coupling between different winding layers.

FIG. 1 illustrates a single primary winding layer 104 (e.g., one row of winding wire turns spaced an equal distance from the core 102), a single secondary winding layer 106, and a single screen layer 108. In other embodiments (and as further described below), the transformer 100 may include more than one primary winding layer 104, more than one secondary winding layer 106 and/or more than one screen layer 108.

For example, in some embodiments, the transformer 100 may include multiple secondary winding layers 106, including but not limited to multiple parallel secondary winding layers in a sandwich arrangement to reduce leakage inductance, to lower copper losses in the secondary winding wire 110, etc. The design of the secondary winding layer 106 may be selected to achieve an appropriate current density in the secondary winding layer 106.

The secondary winding layer 106 is formed by secondary winding wire 110, and the screen layer 108 is formed by screen wire 112. The wires 110 and 112 may include any suitable conductors. Although FIG. 1 illustrates the secondary winding wire 110 as cylindrical and the screen wire 112 as substantially flat, other embodiments may have flat secondary winding wires 110, cylindrical screen wires 112, etc.

In some embodiments, the secondary winding wire 110 may include multi-strand Litz wire to reduce alternating current (AC) losses in the secondary winding wire 110. Similarly, the winding wire of the primary winding layer 104 may include any suitable winding wire, including multi-strand Litz wire.

The screen wire 112 forming screen layer 108 may include any suitable conductive material capable of reducing a noise voltage in the transformer 100. For example, the screen wire 112 may include enameled copper, enameled foil, flat parallel bonded multifilar enameled wire (e.g., for low volume applications), etc.

As mentioned above, screen wire 112 has substantially the same width as secondary winding wire 110. For example, the widths of screen wire 112 and secondary winding wire 110 may be identical. In some embodiments, a diameter of the secondary winding wire 110 and a width of the screen wire 112 may fill an available bobbin width of the transformer 100.

Similarly, the screen layer 108 has substantially the same number of turns as the secondary winding layer 106 (e.g., the screen layer 108 and secondary winding layer 106 may have an identical number of turns). For example, as shown in FIG. 1, the secondary winding layer 106 has four turns and the screen layer 108 has four turns. Other embodiments may include more or less turns per secondary winding layer 106 and screen layer 108 (e.g., one turn per layer, three turns per layer, six turns per layer, etc.).

If the transformer 100 includes multiple secondary winding layers 106 and/or screen layers 108, the screen winding (s) may have a same number of winding wire turns per layer as the secondary winding (s). In some embodiments, some partial difference in angular displacement (e.g., plus or minus a few degrees, etc.) between the screen windings and the secondary windings (due to winding lead out considerations, etc.), may be used to fine trim, compensate for external stray coupling effects, etc., to reduce the noise voltage (e.g., to eliminate noise voltage).

When the screen wire 112 of screen layer 108 has the same width as the secondary winding wire 110 of secondary winding layer 106, and the same number of turns per layer, voltage between the screen layer 108 and the secondary winding layer 106 can be about zero volts during normal operation of the transformer 100. Accordingly, the arrangement of the screen layer 108 in transformer 100 reduces (e.g., eliminates) common mode noise in the transformer 100. For example, the arrangement of the screen layer 108 in the transformer may reduce electrical noise such as high frequency current between the primary winding layer 104 and secondary winding layer 106 caused by capacitive coupling between windings of the transformer and noise voltage across that capacitance. The screen layer 108 reduces (e.g., eliminates) the noise voltage across the capacitance and reduces noise current flow in the transformer 100 and any circuits and/or components coupled to the transformer 100.

The transformer 100 may be used in any suitable application to reduce common mode noise, including but not limited to switched-mode power converters (e.g., power supplies). For example, the transformer 100 may be used in small power converters for charging mobile devices and/or tablets (e.g., for charging device batteries), notebook power adaptors, etc., where reduced size and increased efficiency are desirable. The transformer 100 may be used in products sensitive to common mode noise such as touch screen devices where electrical noise coupled between windings of a transformer can make touch control features inoperable. For example, the transformer 100 can be used in chargers and adaptors using flyback converter configurations for mobile applications where full functionality is needed while charging the device. The transformer 100 may be used to reduce temperature rise in a power converter by reducing common mode noise currents and heat generated by the common mode noise currents.

Figure 2:
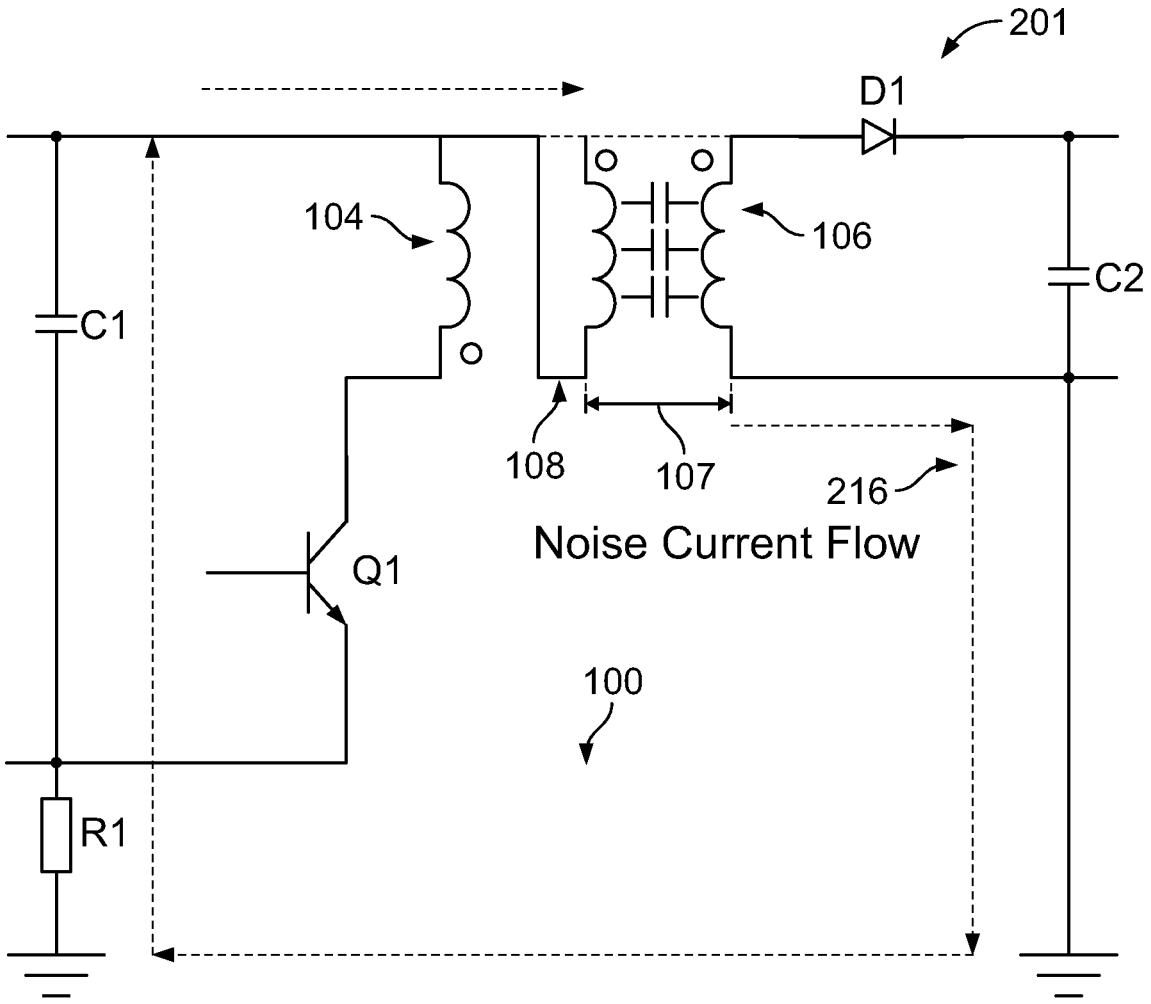
FIG. 2 is a circuit diagram of a power converter including the transformer of FIG. 1, according to another example embodiment of the present disclosure.

FIG. 2 illustrates an example power converter 201 including the transformer 100. As described above, capacitive coupling between the windings of the primary winding layer 104 and the secondary winding layer 106 of the transformer 100 can create a noise voltage between the primary winding layer 104 and the secondary winding layer 106.

The noise voltage can cause a noise current flow 216 (indicated by the dashed lines and arrows in FIG. 2) through the transformer 100 from the primary winding layer 104 to the secondary winding layer 106. The generated noise current 216 also flows through other components of the converter 201, such as resistance R1, switch Q1, etc.

In FIG. 2, resistor R1 represents an intrinsic resistance to earth ground of an alternating current (AC) power utility for high frequency noise. Noise current may be generated at the switching transistor Q1 and flow from the transistor Q1 through any capacitance that exists between the transistor Q1, the windings of transformer 100 and the secondary circuit of the converter 201. On the secondary side of the transformer 100, noise current may flow though capacitance C2, through a hard connection to earth ground, etc.

The screen layer 108 of the transformer 100 reduces the noise voltage and resulting common mode noise currents through the transformer 100 and other components of the converter 201. As shown in FIG. 2, a capacitance 107 exists between the screen layer 108 and the secondary winding layer 106 due to capacitive coupling of the windings of the transformer 100. Although it can be difficult to reduce the capacitance 107, the screen layer 108 can reduce the noise voltage across the capacitance 107, and thus reduce the resulting noise current flow 216.

Accordingly, the converter 201 may have lower (e.g., reduced) common mode noise in the secondary winding layer 106, may have higher (e.g., increased) efficiency, etc. The screen layer 108 of the transformer 100 can allow for leakage inductance due to winding wire height to be reduced (e.g., minimized).

In some embodiments, a transformer may include an auxiliary winding wound about a core of the transformer. For example, the auxiliary winding may have a higher voltage than the secondary winding layer. The auxiliary winding layer may be used to drive circuits on a primary side of a converter having the transformer.

Figure 3:
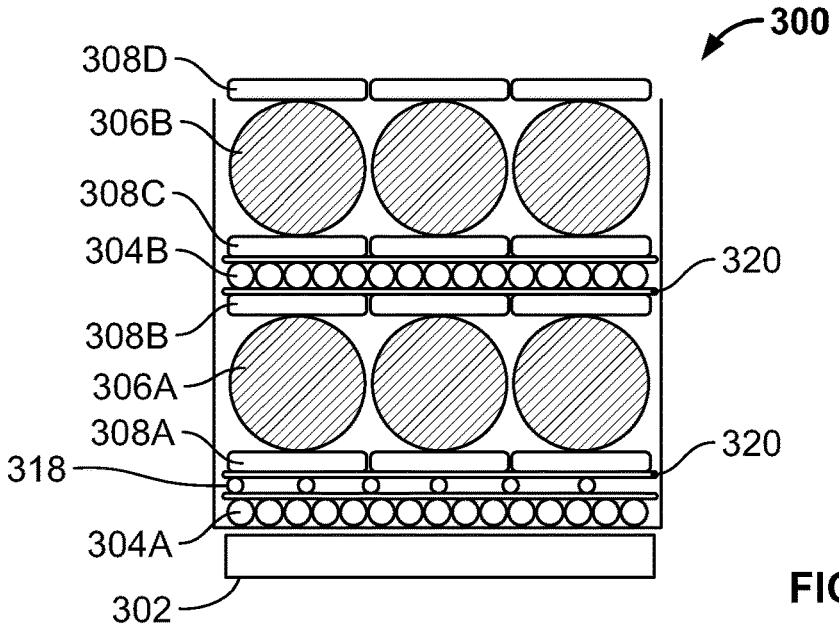
FIG. 3 is a sectional view of an arrangement of winding layers of a transformer according to yet another example embodiment of the present disclosure.
Figure 4:
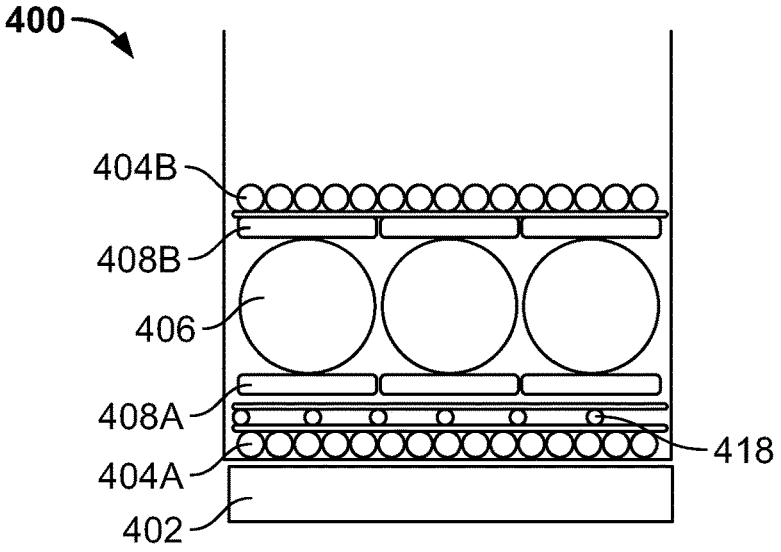
FIG. 4 is a sectional view an arrangement of winding layers of a transformer having a single secondary winding layer, according to a further example embodiment of the present disclosure.
Figure 5:
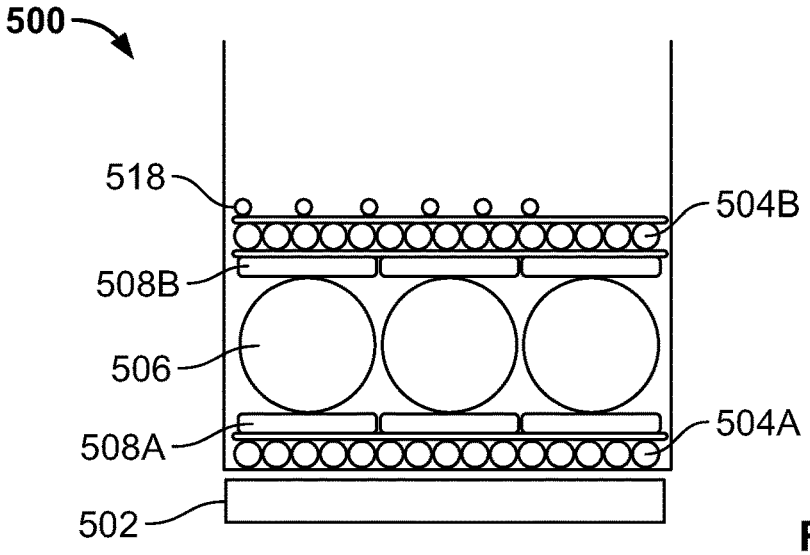
FIG. 5 is a sectional view of an arrangement of winding layers of a transformer having an outer auxiliary winding layer, according to another example embodiment of the present disclosure.

Accordingly, some embodiments of the present disclosure can include a transformer having a simpler primary winding layer, auxiliary winding layer, secondary winding layer topology (e.g., winding arrangement, construction, build, etc.). In other embodiments, the topology of the transformer may be more complicated and include a form of sandwich construction (e.g., parallel layers, etc.). FIGS. 3-5 illustrate example sandwich transformer constructions that include primary, secondary, auxiliary and screen layers.

As shown in FIG. 3, a transformer 300 includes primary winding layer 304A, primary winding layer 304B, secondary winding layer 306A and secondary winding layer 306B. The transformer 300 also includes four screen layers 308A, 308B, 308C and 308D, and an auxiliary winding layer 318. Insulation layers 320 are provided between windings.

The winding order of the transformer 300 starts with primary winding layer 304A wound about the transformer core 302. After the primary winding layer 304A, the winding arrangement order continues with auxiliary winding layer 318, screen layer 308A, secondary winding layer 306A, screen layer 308B, primary winding layer 304B, screen layer 308C, secondary winding layer 306B, and screen layer 308D.

As another example illustrated in FIG. 4, a transformer 400 includes primary winding layer 404A, primary winding layer 404B, and secondary winding layer 406. The transformer 400 also includes two screen layers 408A and 408B, and an auxiliary winding layer 418.

The winding order of the transformer 400 starts with primary winding layer 404A wound about the transformer core 402. After the primary winding layer 404A, the winding arrangement order continues with auxiliary winding layer 418, screen layer 408A, secondary winding layer 406, screen layer 408B, and primary winding layer 404B.

As another example illustrated in FIG. 5, a transformer 500 includes primary winding layer 504A, primary winding layer 504B, and secondary winding layer 506. The transformer 500 also includes two screen layers 508A and 508B, and an auxiliary winding layer 518.

The winding order of the transformer 500 starts with primary winding layer 504A wound about the transformer core 502. After the primary winding layer 504A, the winding arrangement order continues with screen layer 508A, secondary winding layer 506, screen layer 508B, primary winding layer 504B, and auxiliary winding layer 518.

Other embodiments may include transformer winding arrangements different from those illustrated in the example transformer winding arrangements of FIGS. 3-5. For example, in some embodiments the outer screen layer (i.e., furthest from the transformer core) may be optionally removed from the transformer, may be moved to adjacent a bottom (e.g., inner) portion of the auxiliary winding layer, etc. In some embodiments, a multi-turn screen can also be overwound on an additional layer to provide a voltage to the auxiliary winding. In those cases, a phasing or location of an auxiliary rectifier in an auxiliary circuit of a converter should be the same as the phasing or location of a secondary rectifier in a secondary circuit of the converter.

Figure 6:
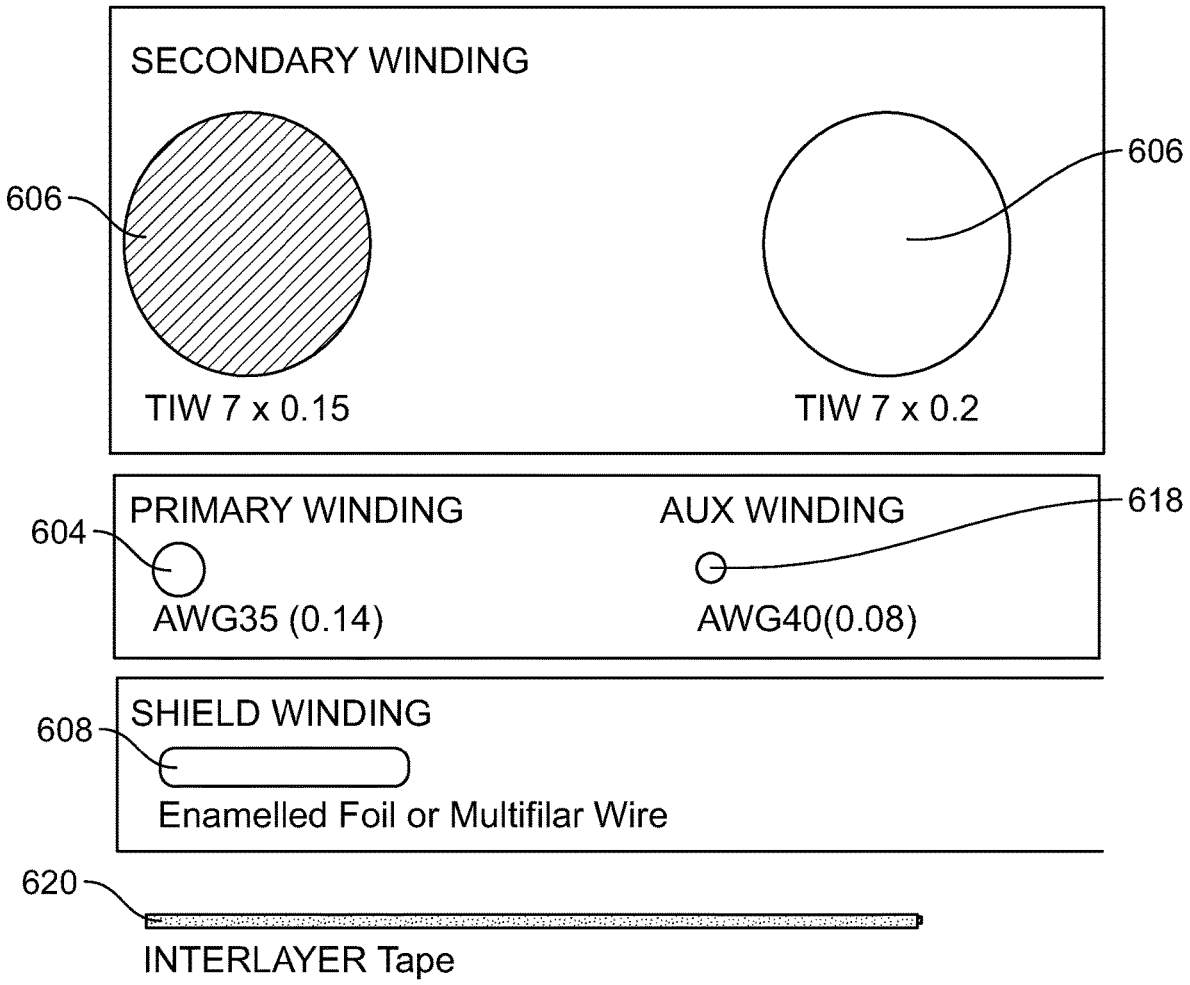
FIG. 6 is a diagram of example winding wire sizes for the winding layers of FIGS. 3-5.

FIG. 6 illustrates example dimensions of winding wire that may be used in some embodiments of the present disclosure. For example, secondary winding wire 606 may include triple insulated wire (TIW) having seven strands of approximately 0.15 millimeter diameter, TIW having seven strands of approximately 0.2 millimeter diameter, etc. The secondary winding wire 606 may have a Litz wire construction (e.g., consist of a number of individually insulated wire strands that are twisted, braided, woven etc. together into a pattern).

The primary winding wire 604 may have an American wire gauge (AWG) size of 35 with a diameter of approximately 0.14 millimeters. The auxiliary winding 618 may have an AWG size of 40 with a diameter of about 0.08 millimeters.

As mentioned above, the screen layer 608 may include any conductive material such as an enameled foil, multifilar wire, etc. The insulation layer 620 can include an interlayer tape, any other suitable insulation material, etc.

The example dimensions and materials listed in FIG. 6 are for purposes of illustration only, and other embodiments may include other suitable wire dimensions, materials, etc., without departing from the scope of the present disclosure.

Figure 7:
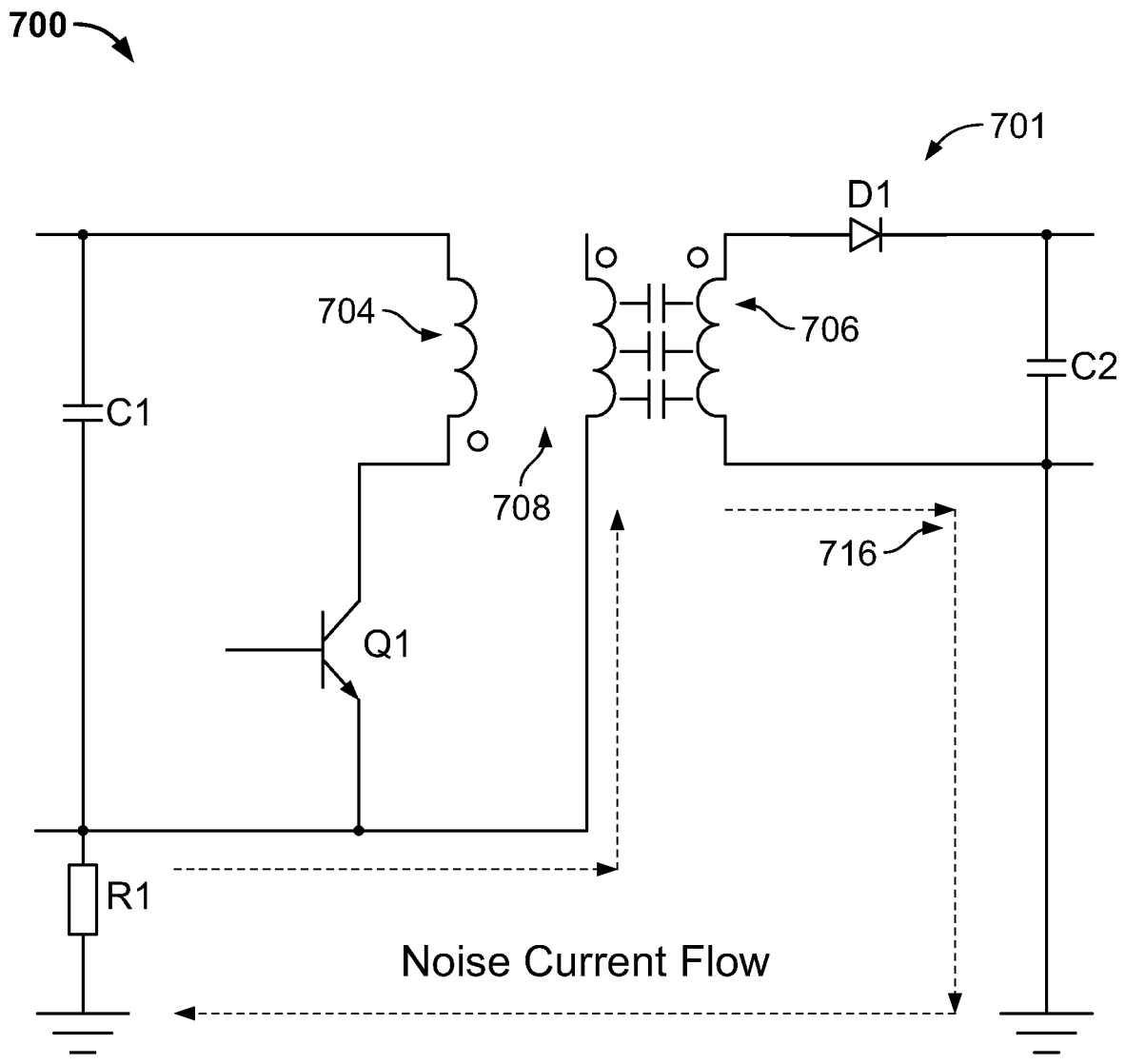
FIG. 7 is a circuit diagram of a power converter having an alternative grounding connection for the transformer, according to another example embodiment of the present disclosure.

FIG. 7 illustrates a converter 701 according to another example embodiment of the present disclosure. The converter 701 is similar to the converter 201 of FIG. 2, but the screen layer 708 of transformer 700 is grounded to a different ground connection.

As shown in FIG. 7, the screen layer 708 positioned between the primary winding layer 704 and the secondary winding layer 706 is grounded through resistor R1 of converter 701. This results in a different current path for noise current flow 716.

Figure 8:
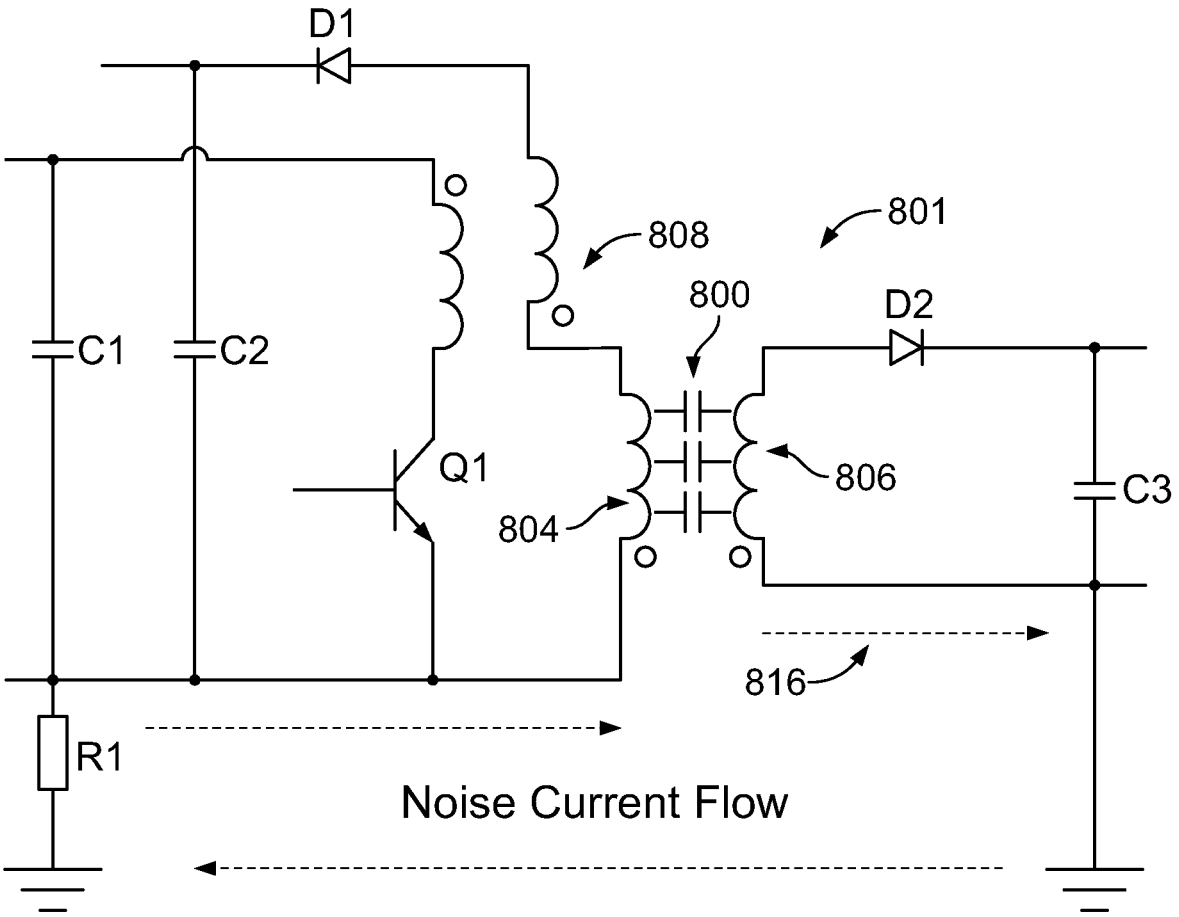
FIG. 8 is a circuit diagram of a power converter having an overwound transformer, according to yet another example embodiment of the present disclosure.

FIG. 8 illustrates a converter 801 according to another example embodiment of the present disclosure. The converter 801 is similar to the converter 201 of FIG. 2, but the screen layer 808 includes an overwound layer to provide an auxiliary voltage for the converter 801.

In another embodiment, a method of winding a transformer is disclosed. The transformer includes a core, at least one primary winding layer, at least one secondary winding layer, and at least one screen layer. The method includes winding the at least one primary winding layer wound about the core of the transformer, and winding the at least one secondary winding layer about the core of the transformer. The at least one secondary winding layer includes a secondary winding wire having a width. The method also includes winding the at least one screen layer about the core of the transformer so the at least one screen layer is disposed between the at least one primary winding layer and the at least one secondary winding layer. The at least one screen layer includes a screen wire having a substantially same width as the width of the secondary winding wire and substantially the same turns per layer as the at least one secondary winding layer, to reduce common mode noise in the at least one secondary winding layer.

The method may also winding at least one auxiliary winding layer about the core of the transformer. Winding the at least one primary winding layer can include winding the at least one primary winding layer adjacent the core of the transformer, and winding the at least one auxiliary winding layer about the at least one primary winding layer. Winding the at least one screen layer may include winding the at least one screen layer about the at least one auxiliary winding layer, and winding the at least one secondary winding layer about the at least one screen layer.

In some embodiments, the method may further include winding a second screen layer about the at least one secondary winding layer, and winding a second primary winding layer about the second screen layer. The method can include winding a third screen layer about the second primary winding layer, winding a second secondary winding layer about the third screen layer, and winding a fourth screen layer about the second secondary winding layer.

In some embodiments, winding the at least one primary winding layer may include winding the at least one primary winding layer adjacent the core of the transformer, winding the at least one screen layer about the at least one primary winding layer, and winding the at least one secondary winding layer about the at least one screen layer. In these cases, the method may further include winding a second screen layer about the at least one secondary winding layer, winding a second primary winding layer about the second screen layer, and winding an auxiliary winding layer about the second primary winding layer.

Any of the example embodiments and aspects disclosed herein may be used in any suitable combination with any other example embodiments and aspects disclosed herein without departing from the scope of the present disclosure. For example, transformers described herein may be wound using other suitable winding methods, the winding methods described herein may be implemented to wind other transformers, etc., without departing from the scope of the present disclosure.

Example embodiments described herein may provide one or more (or none) of the following advantages: a thin screen height to allow for lower leakage inductance and higher converter efficiency, a reduction (e.g., elimination) of the effect of the volts per turn of the secondary winding on the common mode noise, a reduction (e.g., elimination) of the effect of variations in winding wire tension on variations in common mode noise, a screen layer design that can be used in a multi-layer sandwich construction, a screen layer that can contribute to winding functionality, accommodation of design issues for miniature sized transformers, simpler requirements for processing the transformers, easier maintenance of safety isolation in the transformer, allowing mobile devices having touch screens to function while charging, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A transformer comprising:

at least one transformer core;

at least one primary winding layer wound about the transformer core, the at least one primary winding layer including a first primary winding layer and a second primary winding layer;

a first secondary winding layer wound about the transformer core the first secondary winding layer including a secondary winding wire having a width and a number of turns per layer;

at least one auxiliary winding layer wound about the transformer core; and at least one screen layer wound about the transformer core, the at least one screen layer including a first screen layer and a second screen layer the at least one screen layer including a screen wire having substantially the same width as the secondary winding wire and substantially the same number of turns as the first secondary winding layer to reduce common mode noise in the first secondary winding layer, the at least one screen layer including a grounding connection for grounding the at least one screen layer;

wherein the respective winding and screen layers wound about the transformer core in an order of the first primary winding layer, the auxiliary winding layer, the first screen layer, the first secondary winding layer, the second screen layer, and the second primary winding layer.

2. The transformer of claim 1, wherein the at least one screen layer comprises enameled copper.

3. The transformer of claim 1, wherein the at least one screen layer comprises enameled foil.

4. The transformer of claim 1, wherein the at least one screen layer comprises flat parallel bonded multifilar enameled wire.

5. The transformer of claim 1, wherein the at least one primary winding layer includes a primary winding wire;

wherein the first secondary winding layer includes a secondary winding wire; and wherein at least one of the primary winding wire and the secondary winding wire comprises multi-strand Litz wire.

6. The transformer of claim 1, wherein:

the at least one primary winding layer includes a first primary winding layer and a second primary winding layer;

the at least one screen layer includes a first screen layer, and a second screen layer; and the respective winding and screen layers are wound about the transformer core in an order of the first primary winding layer, the first screen layer, the secondary winding layer, the second screen layer, the second primary winding layer, and the auxiliary winding layer.

7. The transformer of claim 1, wherein a voltage between the at least one screen layer and the at least one secondary winding layer is zero during normal operation of the transformer.

8. The transformer of claim 1, wherein the at least one screen layer further comprises a third screen layer wound outside the second primary winding layer.

9. The transformer of claim 8, further comprising a second secondary winding layer wound outside the third screen layer.

10. The transformer of claim 9, further comprising a fourth screen layer wound outside the second secondary winding layer.

11. The transformer of claim 10, wherein the fourth screen layer is an outer layer of the transformer to provide a voltage to the auxiliary winding layer.

12. A transformer comprising:

at least one transformer core;

at least one primary winding layer wound about the transformer core, the at least one primary winding layer including a first primary winding layer and a second primary winding layer;

at least one secondary winding layer wound about the transformer core, the at least one secondary winding layer including a secondary winding wire having a width and a number of turns per layer, the at least one secondary winding layer including a first secondary winding layer and a second secondary winding layer;

at least one auxiliary winding layer wound about the transformer core; and at least one screen layer wound about the transformer core and disposed between the at least one primary winding layer and the at least one secondary winding layer, the at least one screen layer including a screen wire having substantially the same width as the secondary winding wire and substantially the same number of turns as the at least one secondary winding layer to reduce common mode noise in the at least one secondary winding layer, the at least one screen layer including a first screen layer, a second screen layer, a third screen layer, and a fourth screen layer, the respective winding and screen layers wound about the transformer core in an order of the first primary winding layer, the auxiliary winding layer, the first screen layer, the first secondary winding layer, the second screen layer, the second primary winding layer, the third screen layer, the second secondary winding layer, and the fourth screen layer.

13. A transformer comprising:

at least one transformer core;

at least one primary winding layer wound about the transformer core, the at least one primary winding layer including a first primary winding layer and a second primary winding layer;

at least one secondary winding layer wound about the transformer core, the at least one secondary winding layer including a secondary winding wire having a width and a number of turns per layer;

at least one auxiliary winding layer wound about the transformer core; and at least one screen layer wound about the transformer core and disposed between the at least one primary winding layer and the at least one secondary winding layer, the at least one screen layer including a screen wire having substantially the same width as the secondary winding wire and substantially the same number of turns as the at least one secondary winding layer to reduce common mode noise in the at least one secondary winding layer, the at least one screen layer including a first screen layer, and a second screen layer, the respective winding and screen layers wound about the transformer core in an order of the first primary winding layer, the auxiliary winding layer, the first screen layer, the secondary winding layer, the second screen layer, and the second primary winding layer.

14. A method of winding a transformer, the transformer including a core, at least one primary winding layer, at least one secondary winding layer, and at least one screen layer, the method comprising:

winding the at least one primary winding layer about the core of the transformer;

winding the at least one secondary winding layer about the core of the transformer, the at least one secondary winding layer including a secondary winding wire having a width;

winding the at least one screen layer about the core of the transformer so the at least one screen layer is disposed between the at least one primary winding layer and the at least one secondary winding layer, the at least one screen layer including a screen wire having a substantially same width as the width of the secondary winding wire and substantially the same turns per layer as the at least one secondary winding layer to reduce common mode noise in the at least one secondary winding layer, the screen layer including a grounding connection for grounding the screen layer;

winding at least one auxiliary winding layer about the core of the transformer; and wherein:

winding the at least one primary winding layer includes winding the at least one primary winding layer adjacent the core of the transformer;

winding the at least one auxiliary winding layer includes winding the at least one auxiliary winding layer about the at least one primary winding layer;

winding the at least one screen layer includes winding the at least one screen layer about the at least one auxiliary winding layer; and winding the at least one secondary winding layer includes winding the at least one secondary winding layer about the at least one screen layer.

15. A method of winding a transformer, the transformer including a core, at least one primary winding layer, at least one secondary winding layer, and at least one screen layer, the method comprising:

winding the at least one primary winding layer about the core of the transformer;

winding the at least one secondary winding layer about the core of the transformer, the at least one secondary winding layer including a secondary winding wire having a width;

winding the at least one screen layer about the core of the transformer so the at least one screen layer is disposed between the at least one primary winding layer and the at least one secondary winding layer, the at least one screen layer including a screen wire having a substantially same width as the width of the secondary winding wire and substantially the same turns per layer as the at least one secondary winding layer to reduce common mode noise in the at least one secondary winding layer, the screen layer including a grounding connection for grounding the screen layer;

winding a second screen layer about the at least one secondary winding layer;

winding a second primary winding layer about the second screen layer; and winding a third screen layer about the second primary winding layer;

winding a second secondary winding layer about the third screen layer; and winding a fourth screen layer about the second secondary winding layer.

* * * * *